US008601641B2

(12) United States Patent
Conrad

(10) Patent No.: US 8,601,641 B2
(45) Date of Patent: Dec. 10, 2013

(54) REMOVABLE CYCLONE CHAMBER AND DIRT COLLECTION ASSEMBLY FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 461 days.

(21) Appl. No.: 13/040,634

(22) Filed: Mar. 4, 2011

(65) Prior Publication Data

US 2012/0222250 A1 Sep. 6, 2012

(51) Int. Cl.
*A47L 9/10* (2006.01)

(52) U.S. Cl.
USPC ..... 15/347; 15/327.2

(58) Field of Classification Search
USPC ..... 15/347, 351–353, 327.2, 329
See application file for complete search history.

(56) References Cited

U.S. PATENT DOCUMENTS

| | | | | |
|---|---|---|---|---|
| 3,085,221 | A | 4/1963 | Kelly | |
| 4,809,393 | A | 3/1989 | Goodrich et al. | |
| 5,254,019 | A | 10/1993 | Noschese | |
| 5,331,714 | A | 7/1994 | Essex et al. | |
| 6,080,022 | A | 6/2000 | Shaberman et al. | |
| 6,192,550 | B1 | 2/2001 | Hamada et al. | |
| 6,510,583 | B2 | 1/2003 | Griffin et al. | |
| 6,832,408 | B2 | 12/2004 | Roney et al. | |
| 6,929,516 | B2 | 8/2005 | Bruchu et al. | |
| 6,961,975 | B2 * | 11/2005 | Park et al. | 15/329 |
| 6,976,885 | B2 | 12/2005 | Lord | |
| 7,039,985 | B2 | 5/2006 | Hisrich et al. | |
| 7,073,226 | B1 | 7/2006 | Lenkiewicz et al. | |
| 7,380,308 | B2 | 6/2008 | Oh et al. | |
| D581,609 | S | 11/2008 | Conrad | |
| 7,779,505 | B2 | 8/2010 | Krebs et al. | |
| 7,934,286 | B2 * | 5/2011 | Yoo et al. | 15/329 |
| 7,941,895 | B2 | 5/2011 | Conrad | |
| 8,048,180 | B2 | 11/2011 | Oh et al. | |
| 8,062,398 | B2 | 11/2011 | Luo et al. | |
| 8,117,713 | B2 | 2/2012 | Kasper et al. | |
| 2003/0028994 | A1 | 2/2003 | Kitamura et al. | |
| 2004/0216266 | A1 | 11/2004 | Conrad | |
| 2006/0156509 | A1 | 7/2006 | Luebbering et al. | |
| 2006/0248678 | A1 | 11/2006 | Park | |
| 2007/0077810 | A1 | 4/2007 | Gogel et al. | |
| 2008/0134460 | A1 | 6/2008 | Conrad | |

(Continued)

FOREIGN PATENT DOCUMENTS

WO 2011054106 5/2011

OTHER PUBLICATIONS

U.S. Appl. No. 12/722,673, filed Mar. 12, 2010.

(Continued)

*Primary Examiner* — Dung Van Nguyen
(74) *Attorney, Agent, or Firm* — Bereskin & Parr LLP/S.E.N.C.R.L., s.r.l.; Philip C. Mendes da Costa

(57) ABSTRACT

A surface cleaning apparatus comprises an air flow path extending from a dirty air inlet to a clean air outlet. The surface cleaning apparatus may also comprise a main body comprising a suction motor provided in the air flow path and a platform. A cyclone bin assembly may be provided in the air flow path and removably mounted on the platform. The cyclone bin assembly may comprise a cyclone chamber. An alignment member may be provided on the platform and may be located at the air exit path of the cyclone bin.

16 Claims, 13 Drawing Sheets

(56) References Cited

U.S. PATENT DOCUMENTS

| | | | |
|---|---|---|---|
| 2008/0172992 | A1 | 7/2008 | Conrad |
| 2008/0178416 | A1 | 7/2008 | Conrad |
| 2008/0196194 | A1 | 8/2008 | Conrad |
| 2008/0196196 | A1 | 8/2008 | Conrad |
| 2008/0216282 | A1 | 9/2008 | Conrad |
| 2009/0000054 | A1 | 1/2009 | Hampton et al. |
| 2009/0205160 | A1 | 8/2009 | Conrad |
| 2009/0205161 | A1 | 8/2009 | Conrad |
| 2009/0300873 | A1 | 12/2009 | Grey |
| 2010/0242222 | A1 | 9/2010 | Conrad |

OTHER PUBLICATIONS

International Search Report and Written Opinion received on the corresponding international patent application PCT/CA2012/000185, mailed on Jun. 28, 2012.

* cited by examiner 100
336
13
110
108
102
104
272
274
294
298
13

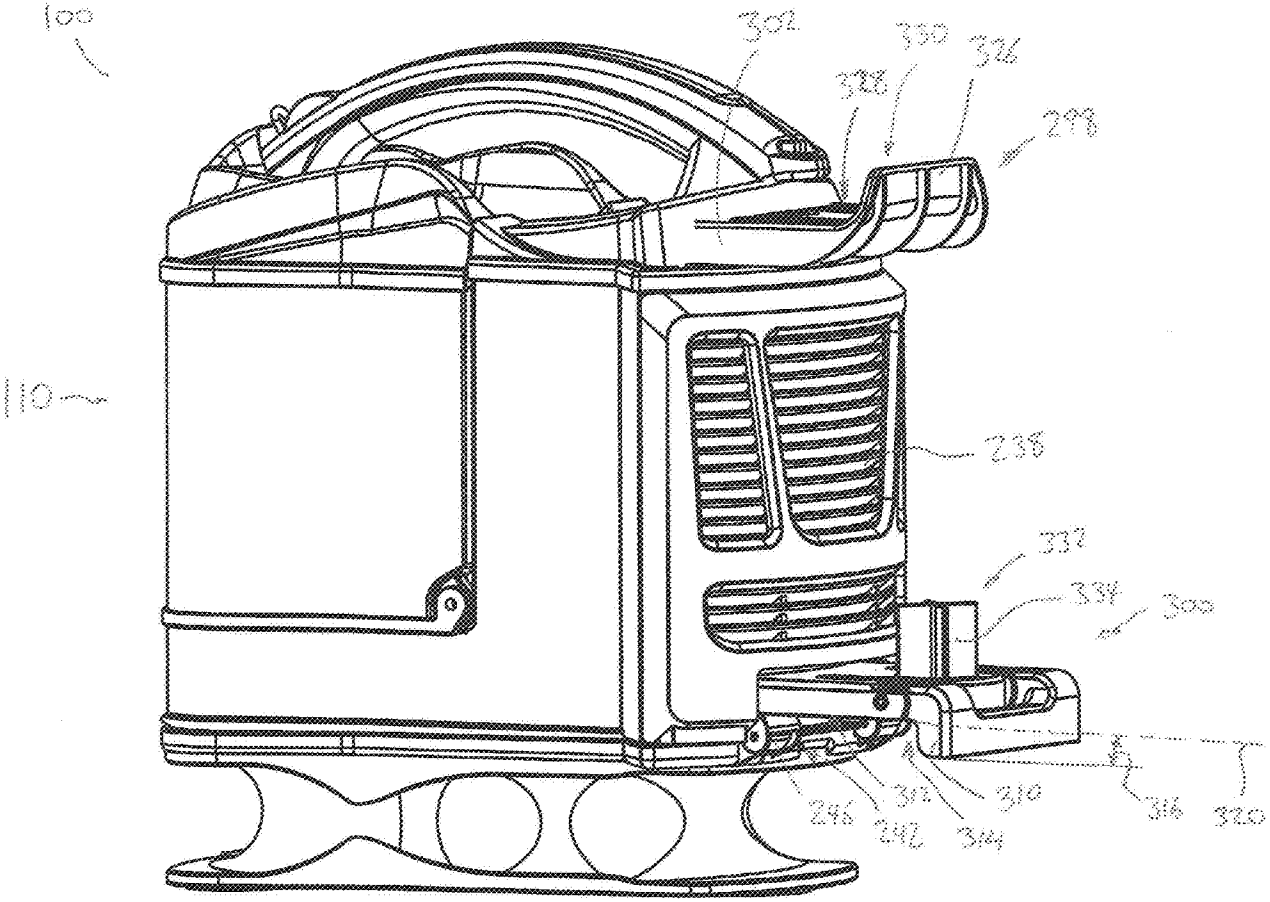
304
332
334
336
338
340
342
344
346
348
350
352
354
356
358
360
362
364
366
368
370
372
374
376
378
380
382
384
386
388
390
392
394
396
398
400
402
404
406
408
410

REMOVABLE CYCLONE CHAMBER AND DIRT COLLECTION ASSEMBLY FOR A SURFACE CLEANING APPARATUS

FIELD

The disclosure relates to surface cleaning apparatuses, such as vacuum cleaners.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one broad aspect, a surface cleaning apparatus has a main body with a removable air treatment member, which preferably comprises a cyclone chamber and a dirt collection chamber. The removable air treatment member can be seated on a platform on the main body. Preferably, the surface cleaning apparatus comprises at least one elongate alignment member that is provided on the platform to help guide the air treatment member when it is being replaced on the main body.

Preferably, the alignment member can include an insert that extends into the cyclone chamber, when the air treatment member is mounted on the body, and can comprise a portion of the air flow path between the dirty air inlet and the clean air outlet. The insert can be received within a vortex finder in the cyclone chamber. Alternatively, the insert may comprise the vortex finder of the air treatment member. In this configuration, the vortex finder is separable from the cyclone chamber when the air treatment member is removed from the main body.

An advantage of this configuration may be that the alignment member may help position in the air treatment member in a desired, operating position, and may reduce the chances of the air treatment member being incorrectly replaced on the main body.

The at least one alignment member may provide alignment in two directions (e.g. left-right and front-back), and preferably allows relative rotation of the air treatment member. Preferably, the surface cleaning apparatus comprises a second alignment member that provides rotational alignment. The rotational alignment member may comprise mating interfitting members, such as a handle that is receivable in a groove, a portion of a suction hose connector received in a cyclone bin assembly, or other suitable feature.

An advantage of this configuration may be that the second alignment member can help ensure the air treatment member is replaced having a desired rotational alignment.

In accordance with this broad aspect, a surface cleaning apparatus comprises an air flow path extending from a dirty air inlet to a clean air outlet. The surface cleaning apparatus may also comprise a main body comprising a suction motor provided in the air flow path and a platform. A cyclone bin assembly may be provided in the air flow path and removably mounted on the platform. The cyclone bin assembly may comprise a cyclone chamber. An alignment member may be provided on the platform and may be located at the air exit path of the cyclone bin.

The cyclone bin may be rotatable about the alignment member.

The alignment member may be tapered.

The alignment member may comprise a portion of the air flow path.

The alignment member may be centrally positioned on the platform.

The alignment member may comprise a vortex finder of the cyclone chamber.

The cyclone chamber may have a vortex finder and the alignment member may comprise an insert receivable in the vortex finder.

The alignment member may comprise a vortex finder of the cyclone chamber or an insert receivable in the vortex finder of the cyclone chamber. The alignment member may be secured to the platform.

The cyclone may be an inverted cyclone.

The surface cleaning apparatus may comprise a second alignment member

When mounted to the main body, the cyclone bin assembly may be in a particular orientation and the second alignment member may align the cyclone bin assembly in the particular orientation.

The cyclone bin assembly may comprise a handle and the handle may comprise the second alignment member.

The main body may have a recess configured to receive a portion of the handle.

The main body may comprise a hose connector. The hose connector may comprise a portion of an air flow path from the dirt air inlet to the cyclone bin assembly. The hose connector may comprise the second alignment member.

The hose connector may be nested in the cyclone bin assembly when the cyclone bin assembly is mounted to the main body.

The hose connector may be provided on the platform and the cyclone bin assembly may have a recess for removably receiving the hose connector.

DRAWINGS

Reference is made in the detailed description to the accompanying drawings, in which:

FIG. 4 is a side view of the side of the surface cleaning apparatus shown in FIG. 2, with a cord retainer in a cord removal position;

FIG. 5 is a rear perspective view of the surface cleaning apparatus of FIG. 2, with a cord retainer in a cord retaining position;

DETAILED DESCRIPTION

Figure 1:
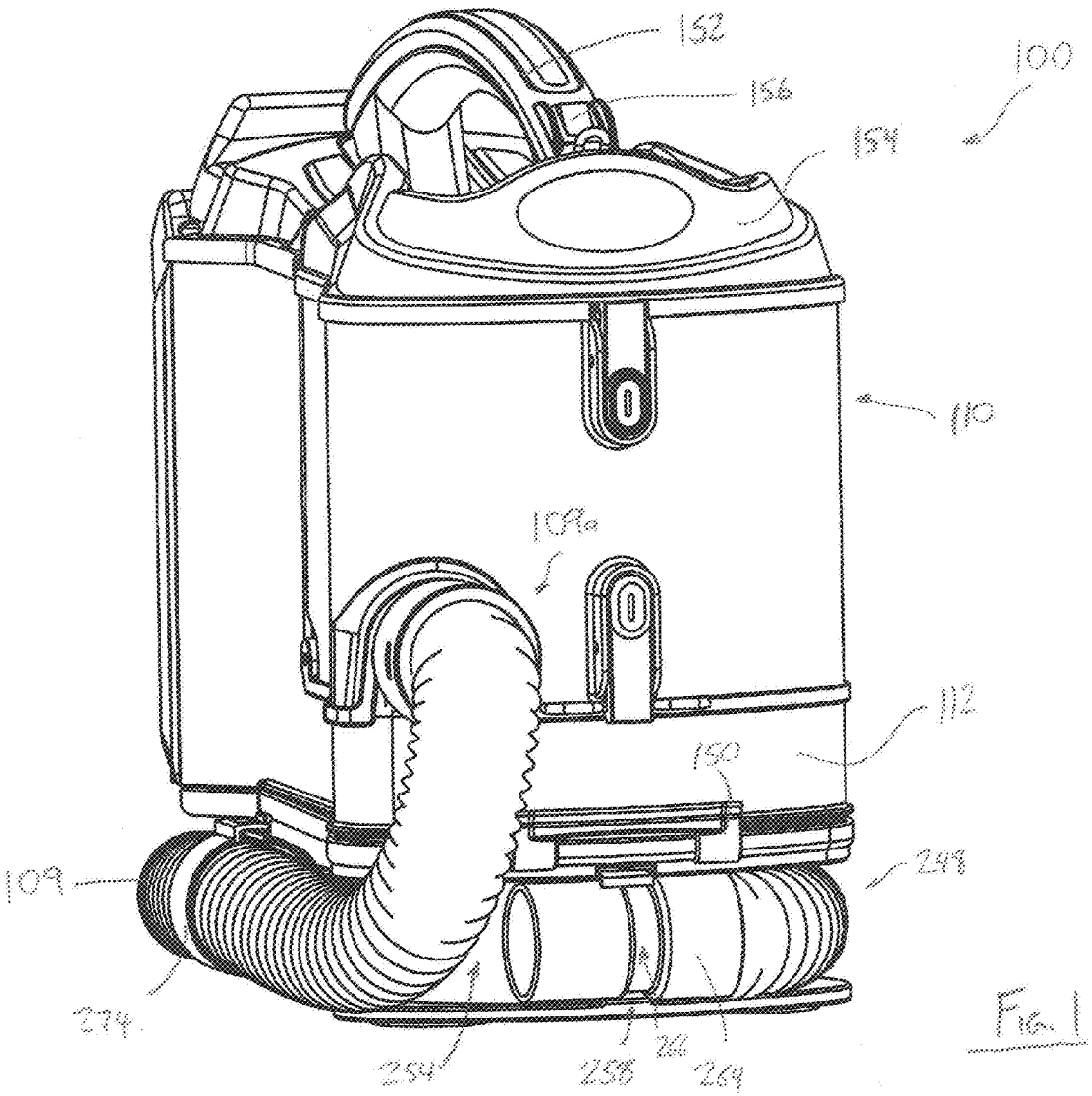
FIG. 1 is a perspective view of an example of a surface cleaning apparatus.

Referring to FIG. 1, an embodiment of a surface cleaning apparatus 100 is shown. In the embodiment illustrated, the surface cleaning apparatus 100 is a hand operable surface cleaning apparatus. In alternate embodiments, the surface cleaning apparatus may be another suitable type of surface cleaning apparatus, including, for example, an upright vacuum cleaner, a canister vacuum cleaner, a stick vac, a wet-dry vacuum cleaner and a carpet extractor. Power can be supplied to the surface cleaning apparatus 100 by an electrical cord (not shown) that can be connected to a standard wall electrical outlet. Alternatively, or in addition, the power source for the surface cleaning apparatus can be an onboard power source, including, for example, one or more batteries.

General Overview

Figure 2:
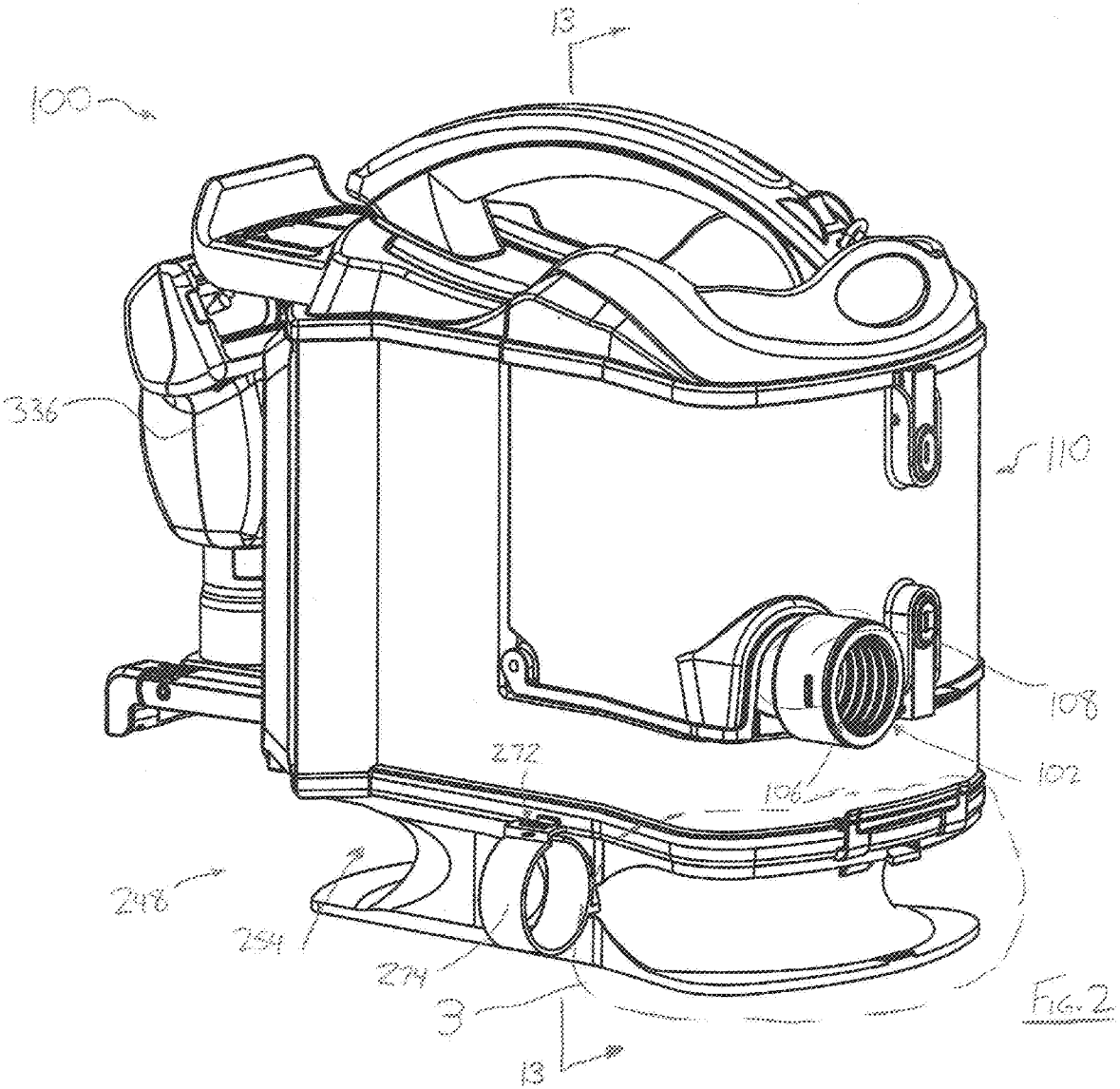
FIG. 2 is a perspective view of the surface cleaning apparatus shown in FIG. 1, with a suction hose removed.

Referring to FIGS. 1 and 2, the surface cleaning apparatus 100 has a dirty air inlet 102, a clean air outlet 104 (see for example FIGS. 4 and 13) and an airflow passage extending therebetween. In the embodiment shown, the dirty air inlet 102 is the air inlet 106 of a suction hose connector 108 that can be connected to the downstream end 109*a* of a flexible suction hose 109 or other type of cleaning accessory tool, including, for example, a wand and a nozzle. From the dirty air inlet 102, the airflow passage extends through an air treatment member that can treat the air in a desired manner, including for example removing dirt particles and debris from the air. In the illustrated example, the air treatment member comprises a cyclone bin assembly 110. The cyclone bin assembly 110 is mounted on a main body 112. Alternatively, the air treatment member can comprise a bag, a filter or other air treating means. A suction motor 114 (FIG. 13) is mounted within the body 112 and is in fluid communication with the cyclone bin assembly 110.

Figure 13:
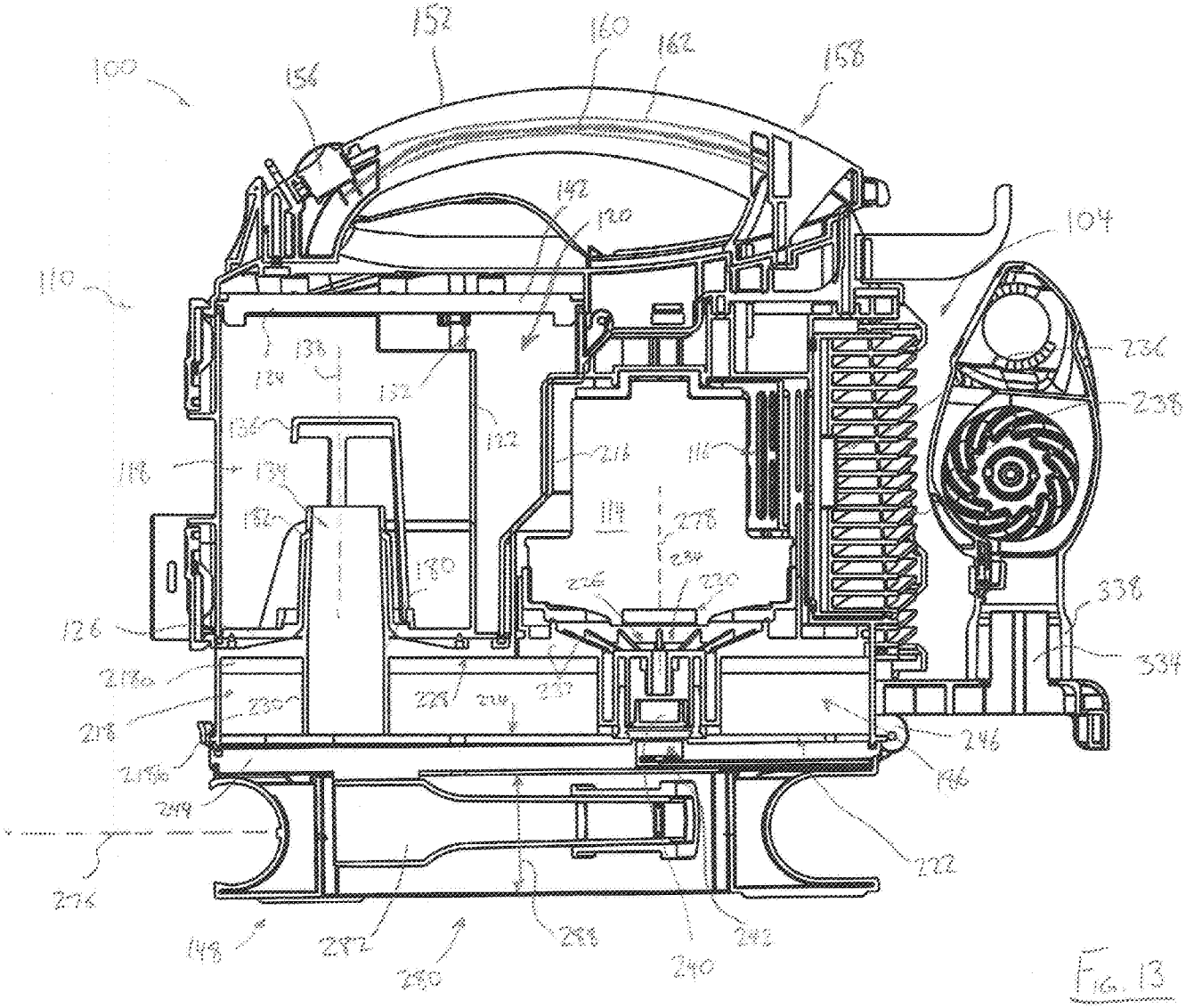

Referring to FIG. 13, the clean air outlet 104, which is in fluid communication with an outlet 116 of the suction motor 114, is provided in the body 112. In the illustrated example, the dirty air inlet 102 is located toward the front of the surface cleaning apparatus 100, and the clear air outlet 104 is located toward the rear.

Cyclone Bin Assembly

Figure 9:
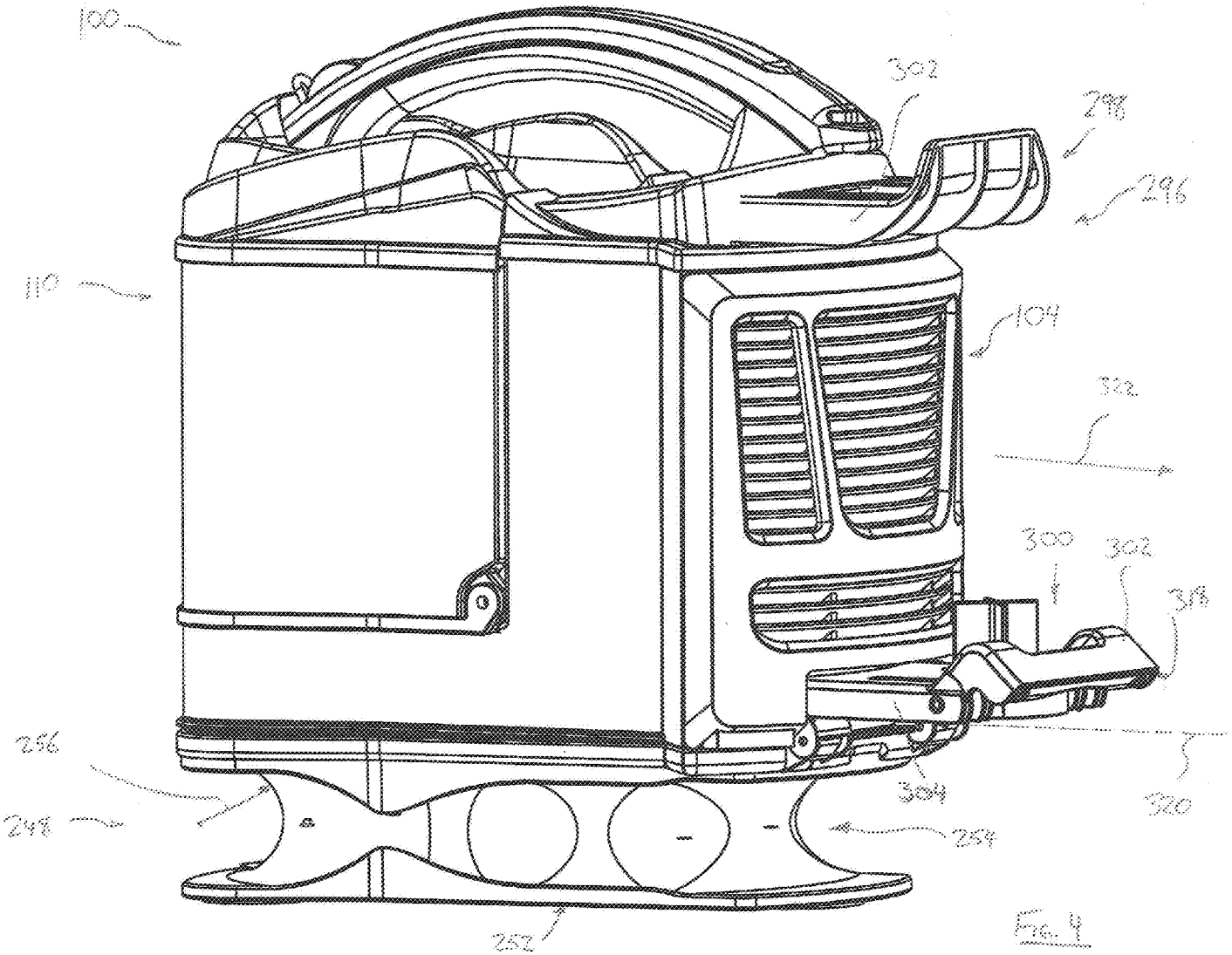
FIG. 9 is a rear perspective view of the surface cleaning apparatus of FIG. 1, with the cyclone bin assembly removed.

Referring to FIGS. 10-13, in the illustrated example, cyclone bin assembly 110 includes a cyclone chamber 118 and a dirt collection chamber 120. The cyclone chamber 118 is bounded by a sidewall 122, a first end wall 124 and a second end wall 126 that are configured to preferably provide an inverted cyclone configuration. A tangential air inlet 128 is provided in the sidewall of the cyclone chamber 118 and is in fluid communication with the air outlet 130 (FIG. 9) of the hose connector 108. Air flowing into the cyclone chamber 118 via the air inlet 128 can circulate around the interior of the cyclone chamber 118 and dirt particles and other debris can become disentrained from the circulating air. It will be appreciated that the cyclone chamber may be of any configuration and that one or more cyclone chambers may be utilized. In the example illustrated the cyclone bin assembly 110, and the cyclone chamber 118 are arranged in a generally vertical, inverted cyclone configuration. Alternatively, the cyclone bin assembly 110 and cyclone chamber 118 can be provided in another orientation, including, for example, as a horizontal cyclone.

Cyclone chamber 118 may be in communication with a dirt collection chamber 120 by any means known in the art. Preferably, as exemplified, the dirt collection chamber 120 is exterior to cyclone chamber 118, and preferably at least partially surrounds and, more preferably completely surrounds, cyclone chamber 118. Accordingly, cyclone chamber 118 is in communication with dirt collection chamber 118 via a dirt outlet 132. Preferably, the dirt outlet 132 comprises a slot 132 formed between the sidewall 122 and the first end wall 124. Slot 124 comprises a gap between an upper portion of cyclone chamber sidewall 122 and the lower surface of first end wall 124. Preferably, the gap extends only part way around sidewall 122. Debris separated from the air flow in the cyclone chamber 118 can travel from the cyclone chamber 118, through the dirt outlet 132 to the dirt collection chamber 120.

Air can exit the cyclone chamber 118 via an air outlet 134. In the illustrated example, the cyclone air outlet includes a vortex finder 134. Optionally, a removable screen 136 can be positioned over the vortex finder 134. The cyclone chamber 118 extends along a longitudinal cyclone axis 138 (FIG. 13). In the example illustrated, the longitudinal cyclone axis 138 is aligned with the orientation of the vortex finder 134.

The dirt collection chamber 120 comprises a sidewall 140, a first end wall 142 and an opposing second end wall 144. In the illustrated example, at least a portion of the dirt collection chamber sidewall 140 is integral with a portion of the cyclone chamber sidewall 122, at least a portion of the first cyclone endwall 124 is integral with a portion of the first dirt collection chamber end wall 142 and/or and at least a portion of the second cyclone end wall 126 is integral with a portion of the second dirt collection chamber end wall 144. The dirt collection chamber 120 extends along a dirt collection axis 146 (F*igure* 146). Optionally, the dirt collection axis 146 can be parallel to and offset from the cyclone axis 138.

The dirt collection chamber 120 may be emptyable by any means known in the art and is preferably openable concurrently with the cyclone chamber 118. Preferably, the second dirt collection chamber end wall 142 is pivotally connected to, e.g., the dirt collection chamber sidewall 140, such as by hinges 212. The second dirt collection chamber end wall 144 can be opened (FIG. 12) to empty dirt and debris from the interior of the dirt collection chamber 120. In the illustrated example, the second cyclone end wall 126 is integral with, and is openable with, the second dirt collection chamber end wall 144. Accordingly, opening the second cyclone end wall 126 can allow dirt and debris to be emptied from the cyclone chamber 118 and the dirt collection chamber 120. The second dirt collection chamber end wall 144 can be retained in the closed position by any means known in the art, such as by a releasable latch 143.

Alternately, or in addition, as shown in the illustrated example, the first cyclone end wall 124 may be integral with, and is openable with, the first dirt collection chamber end wall 142. Accordingly, opening the first cyclone end wall 124 can allow dirt and debris to be emptied from the cyclone chamber 118 and the dirt collection chamber 120. The first dirt collection chamber end wall 142 can be retained in the closed position by any means known in the art, such as by a releasable latch.

A handle 152 is provided on the top of the cyclone bin assembly 110. The handle 152 is configured to be grasped by a user. When the cyclone bin assembly 110 is mounted on the body 112, the handle 152 can be used to manipulate the surface cleaning apparatus 100. When the cyclone bin assembly 110 is removed from the body 112, the handle 152 can be used to carry the cyclone bin assembly 110, for example to position the cyclone bin assembly 110 above a waste receptacle for emptying. In the illustrated example, the handle 152 is integral with a lid 154 of the cyclone bin assembly 110.

Securing the Cyclone Bin Assembly on the Main Body

Figure 7:
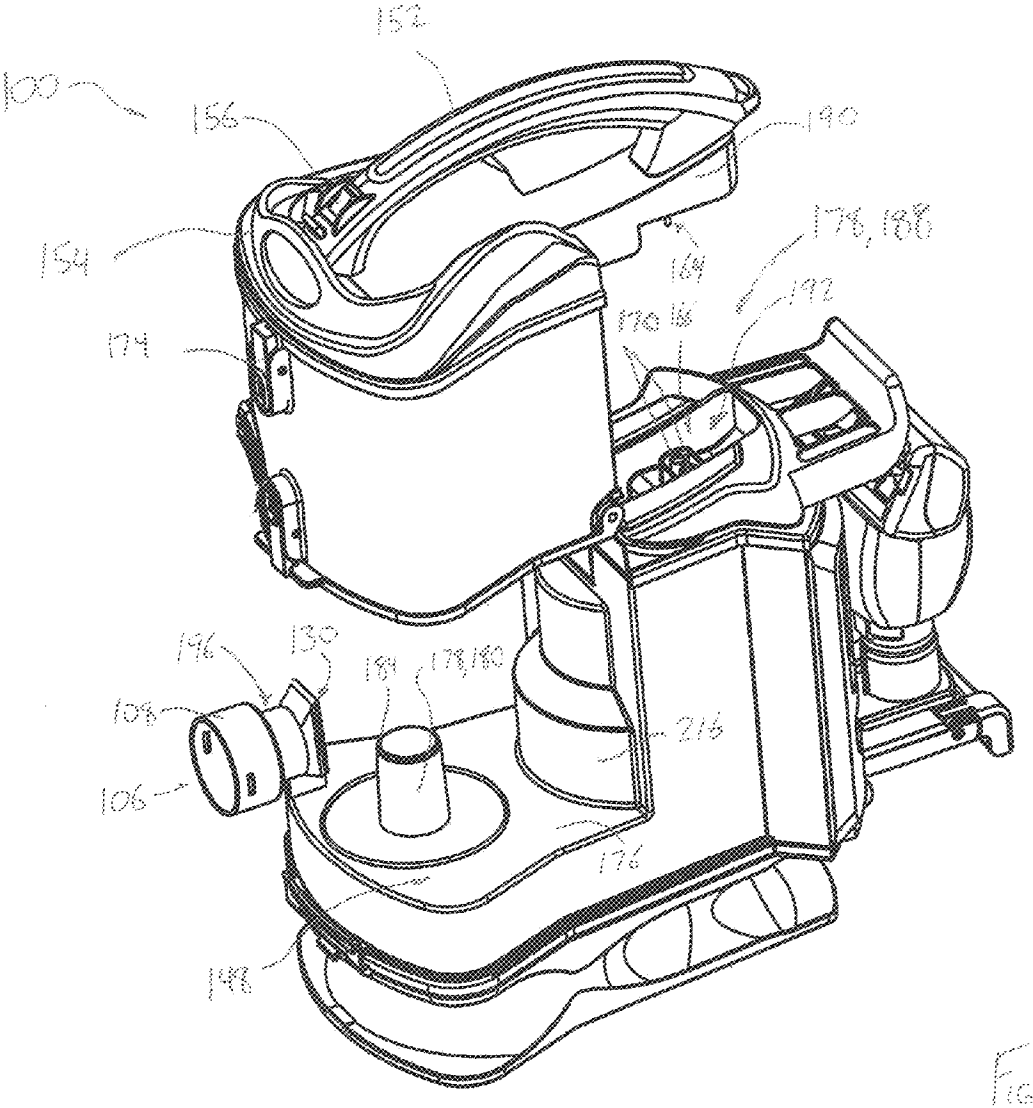
FIG. 7 is a top perspective view of the surface cleaning apparatus of FIG. 2, with a cyclone bin assembly separated from the body.
Figure 8:
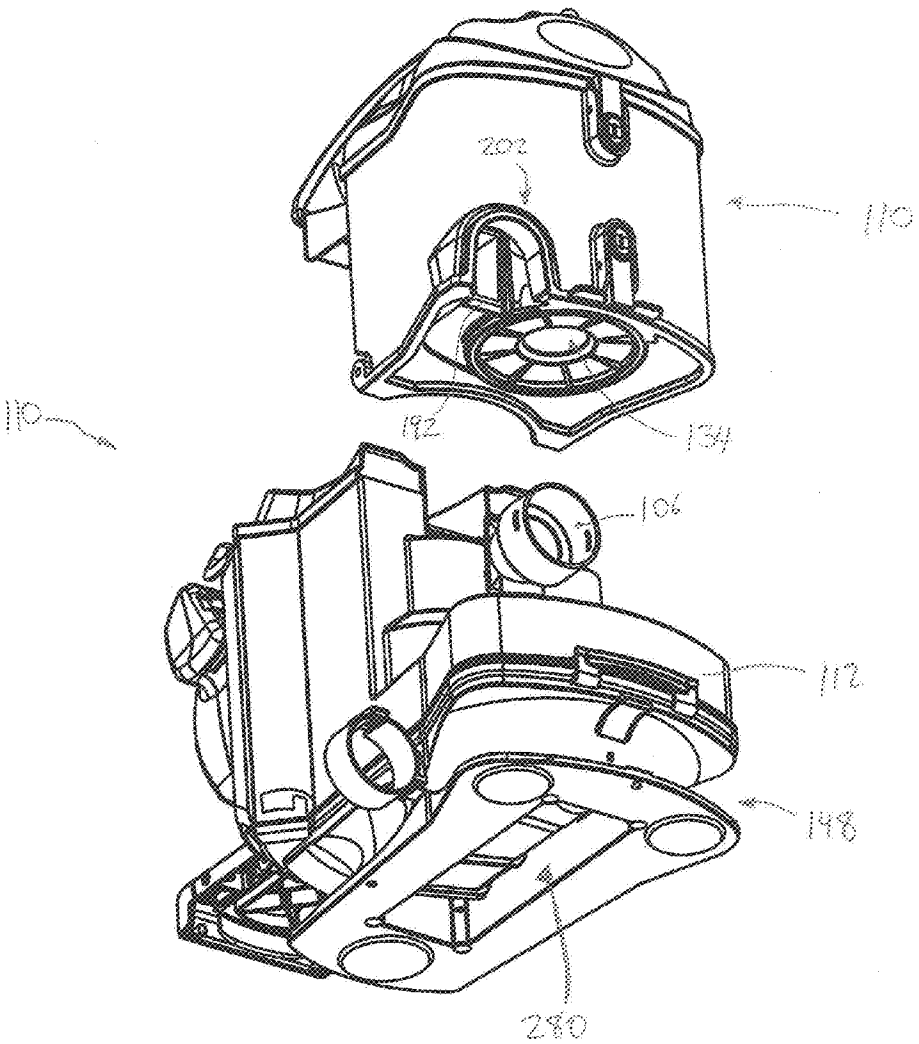
FIG. 8 is a bottom perspective view of the surface cleaning apparatus of FIG. 7.
Figure 9:
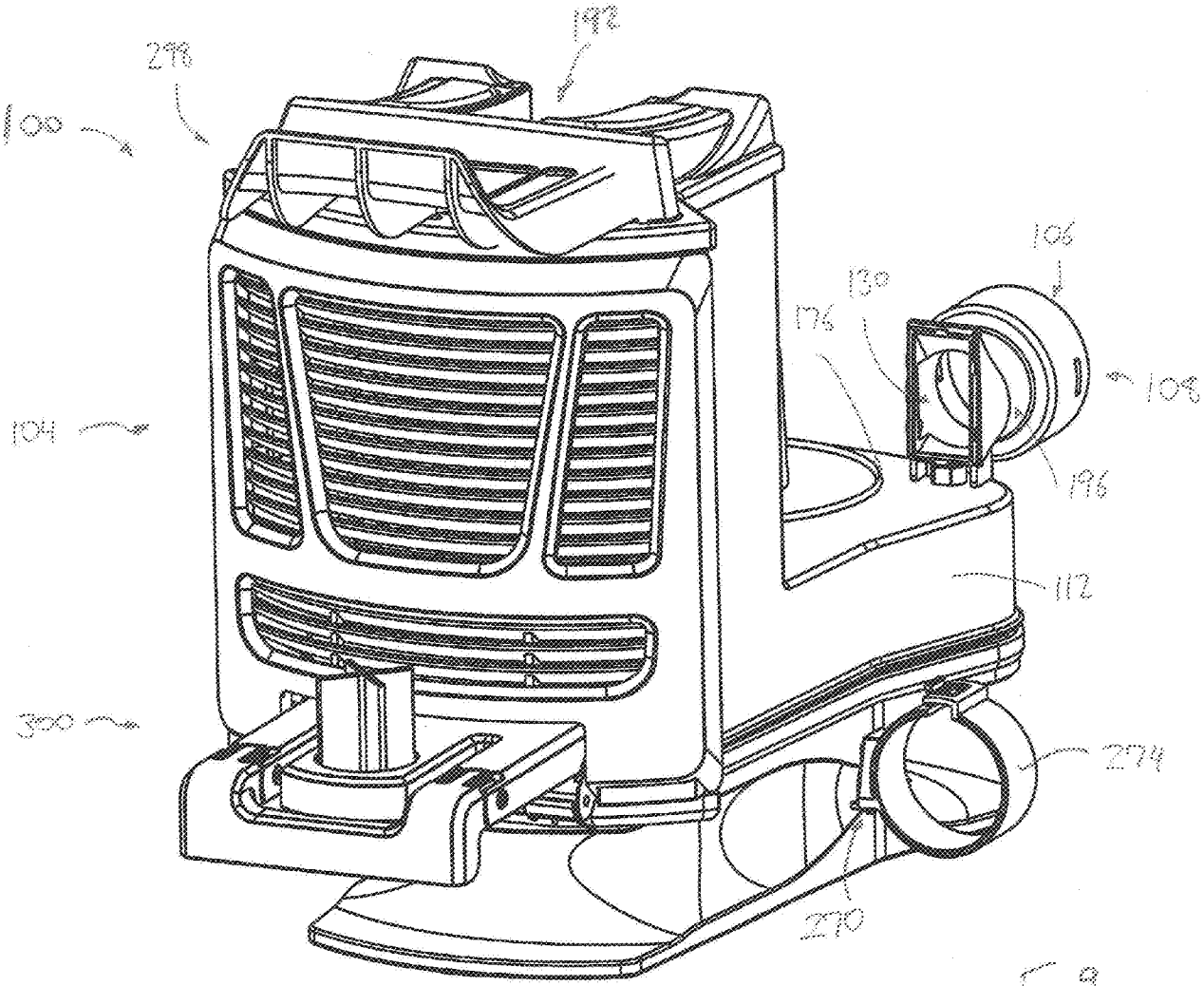

Referring to FIGS. 7 and 8, optionally, the cyclone bin assembly 110 is detachably connected to the body 112. Preferably, as exemplified, the cyclone bin assembly 110 is detachably mounted on a platform 148. One or more releasable latches may be used to secure cyclone bin assembly 110 to main body 112. As exemplified, the rear surface of the cyclone bin assembly 110 abuts against the front wall of the suction motor housing 216 of the main body 112. Accordingly, a single releasable latch 150 (see for example FIG. 2) can be used to secure a front edge of the cyclone bin assembly 110 to the body 112 and thereby secure the cyclone bin assembly 110 to the main body 112. Alternately, two or more securing members may be provided.

Removable Main Power Switch

Referring to FIGS. 7, 8 and 13, a main power switch 156 for the surface cleaning apparatus 100 (e.g. for controlling the operation of the suction motor 114) is removable with cyclone bin assembly 110 and is preferably provided on the lid 154 of the cyclone bin assembly 110. The power switch 156 is connected to the suction motor 114 by a control circuit 158, and is operable to control the supply of power from a power source to the suction motor 114. Preferably, the power switch 156 is positioned in close proximity to the handle 152. Providing the power switch 156 close to, or optionally on, the handle 154 may help allow a user to operate the power switch 156 with the same hand that used to grasp the handle 154.

Control circuit 158 may be of various designs which include main power switch 156 and enable main power switch 156 to be used to selectively actuate the suction motor 114. As exemplified in FIG. 13, the control circuit 158 comprises electrical conduits, for example wires 160, which can be provided internally in cyclone bin assembly 110 (e.g., in an internal handle conduit 162). The plurality of wires 160 can electrically connect the switch 156 to a power source in the body 112 and/or the suction motor 114.

Figure 10:
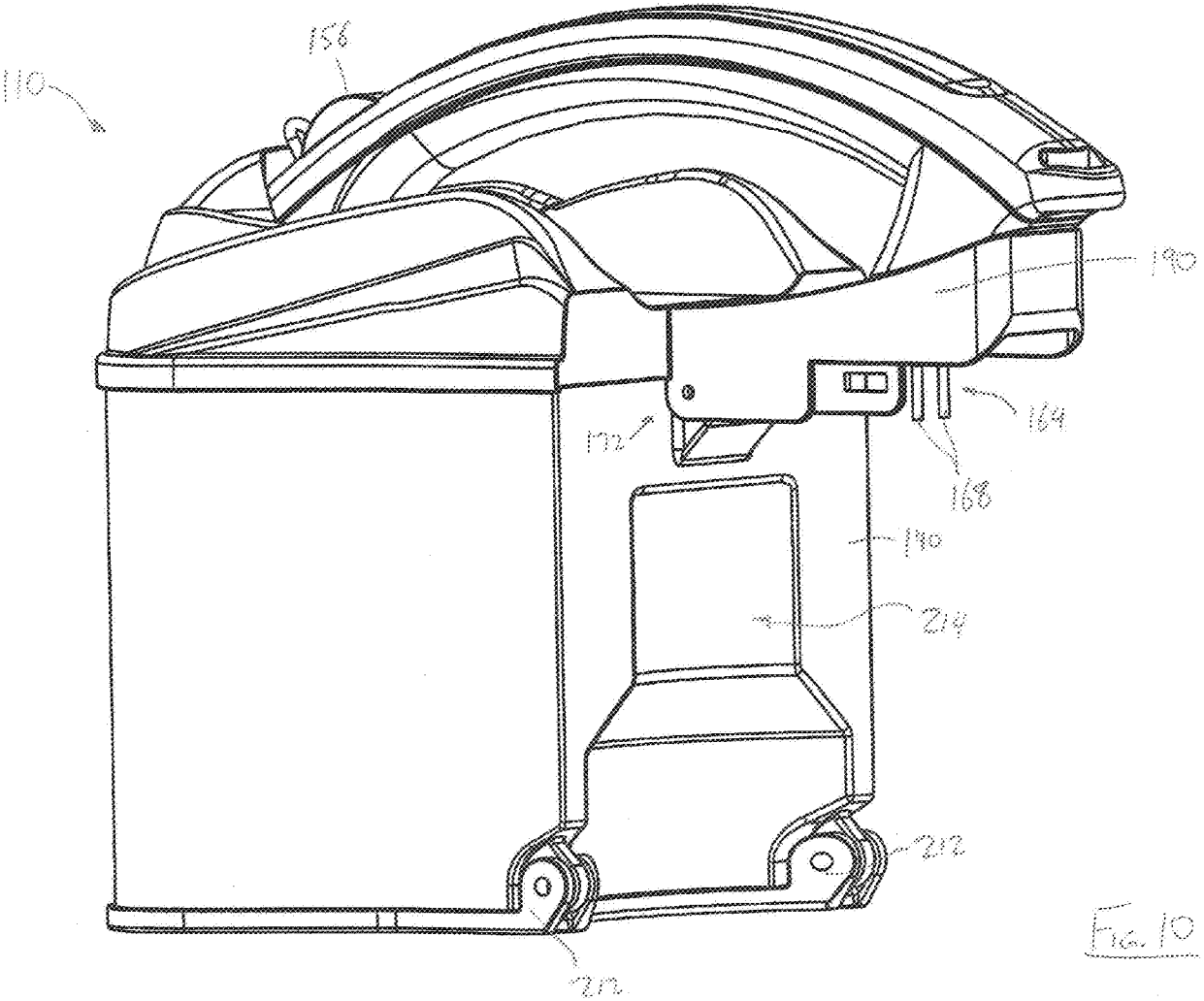
FIG. 10 is a rear perspective view of the cyclone bin assembly.
Figure 11:
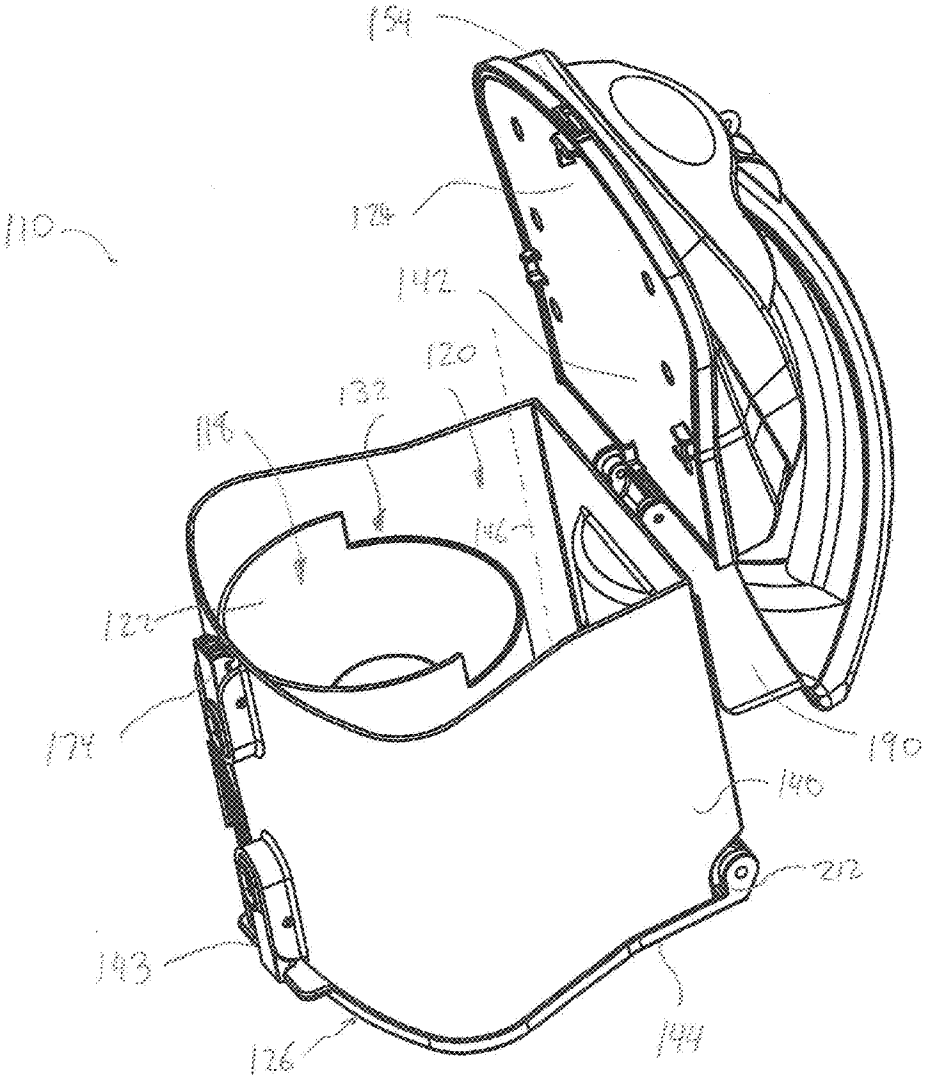
FIG. 11 is top perspective view of the cyclone bin assembly of FIG. 10, with the lid in an open position.

Referring to FIGS. 7 and 10, optionally, the control circuit 158 between the power switch 154 and the suction motor 114 comprises a decoupling member and is interruptible, and the power switch 158 can be detachable from the body 112. In the illustrated example, the decoupling member comprises first and second power connectors 164, 166. The lid 154 of the cyclone bin assembly 110 comprises a first power connector 164 and the body 112 comprises a second, mating power connector 166. When the cyclone bin assembly 110 is mounted on the body 112, the first power connector 164 is electrically coupled to the second power connector 166. Connecting the first and second power connectors 164, 166 can complete an electrical control circuit 158 between the power switch 156 and the suction motor 114 such that main power switch 156 may control the actuation of the suction motor. The first and second power connectors 164, 166 are releasably coupled and can be separated from each other to interrupt the electrical connection between the power switch 156 and the suction motor 114. In the illustrated example, separating the cyclone bin assembly 110 from the body 112 automatically separates the first and second power connectors 164, 166.

In the illustrated example the first power connector 164 is a male power connector, comprising two prongs 168, and the second power connector 166 is a female power connector comprising a two corresponding receptacles 170 to receive the prongs 168. Accordingly, the second power connector 166 can remain connected to a power supply when the cyclone bin assembly 110 is removed. Providing a female power connector 166 on the body 112, instead of a pair of exposed prongs 168, may help reduce the risk of electric shock to a user when the cyclone bin assembly 110 is removed, and the second power connector 166 is exposed.

Alternatively, instead of providing a continuous electrical connection between the power switch 156 and the suction motor 114, the connection between cyclone bin assembly 110 and the body 112 can be another type of control system. For example, instead of providing electrical wires 160 in the handle conduit 162, the control circuit 158 can comprise an electrical circuit housed in the main body that is interruptible by movement of main power switch, e.g., with the cyclone bin assembly 110, away from an in use position on main body 112. For example, a mechanical linkage system may be used. The mechanical linkage system (e.g., an abutment member such as a post) can be configured to translate movements of the power switch 156 to open and close a circuit in the main body. For example, the post may be driving connected to a relay positioned on the body 112 and that forms part of the circuit. The relay can then convert the movements of the mechanical linkage into electrical signals, optionally via onboard electronics, to control the suction motor 114. For example, removing the cyclone bin assembly 110 from the body 112 would move the post out of engagement with the relay thereby permitting the relay to open the circuit.

In another example, the power switch 156 may be connected to an RF (or other type of wireless transmitter) in the cyclone bin assembly 110, and the body 112 can include an RF receiver that can control the operation of the suction motor 114 (or vice versa). The surface cleaning apparatus 100 can also include a proximity sensor configured to sense whether the cyclone bin assembly 118 is mounted on the body 112. In this example, moving the power switch 156 may generate a wireless control signal that is received by the RF receiver. The proximity sensor can be communicably linked to at least one of the RF transmitter or RF receiver and can be configured to deactivate at least one of the RF transmitter or RF receiver when the cyclone bin assembly 110 is removed from the base. Alternately, the proximity sensor could be drivingly connected to a relay or the like to close the relay when the cyclone bin assembly is mounted to main body 112. For example, the proximity sensor could be provided in main body 12 and could be actuated by a magnet provided at a suitable location in cyclone bin assembly 110.

Optionally, the lid 154 need not be attached to cyclone bin assembly 110. Instead, lid 154 may be moveably mounted on main body 12, or removable therefrom, to permit cyclone bin assembly 110 to be removed. As exemplified in FIGS. 10 and 11, the lid 154 may be pivotally mounted to main body 12 by a hinge 172 and moveable between an open position (FIG. 11) wherein the cyclone bin assembly 110 may be removed and a closed position (FIG. 10) wherein the cyclone bin assembly is secured in position. In the illustrated example, the hinge 172 is provided toward the rear of the cyclone bin assembly 110. The lid 154 may be releasably retained in the closed position by any means, such as a latch 174 provided toward the front of the cyclone bin assembly 110. Opening the lid 154 may allow a user to access the interior of the dirt collection chamber 120 and cyclone chamber 118. Optionally, the screen 136 and/or the vortex finder 134 can be removable from the cyclone chamber 118 and can be removed via the top of the cyclone bin assembly 110 when the lid 154 is opened.

Alignment Members for Locating and Orienting the Cyclone Bin Assembly

Referring again to FIGS. 7-9 and 13, the platform 148 may comprise a generally planar bearing surface 176 for supporting the cyclone bin assembly 110. Optionally, the main body may comprise at least one alignment member configured to engage the cyclone bin assembly 110 and thereby align and/or orient the cyclone bin assembly for mounting on main body 12. Preferably at least one of the alignment members is provided on the platform 148. Providing at least one alignment member 178 may help a user to replace the cyclone bin assembly 110 on the platform 148 in a desired, operating position.

In the illustrated, the at least one alignment member 178 comprises a vortex finder insert 180 extending from the platform 148. The vortex finder insert 180 is a hollow conduit and is configured to fit within the vortex finder 134 in the cyclone bin assembly 110. In this configuration, the vortex finder insert 180 can comprise a portion of the air outlet of the cyclone chamber 118, and can comprise a portion of the air flow path between the dirty air inlet 102 and the clean air outlet 104.

Figure 12:
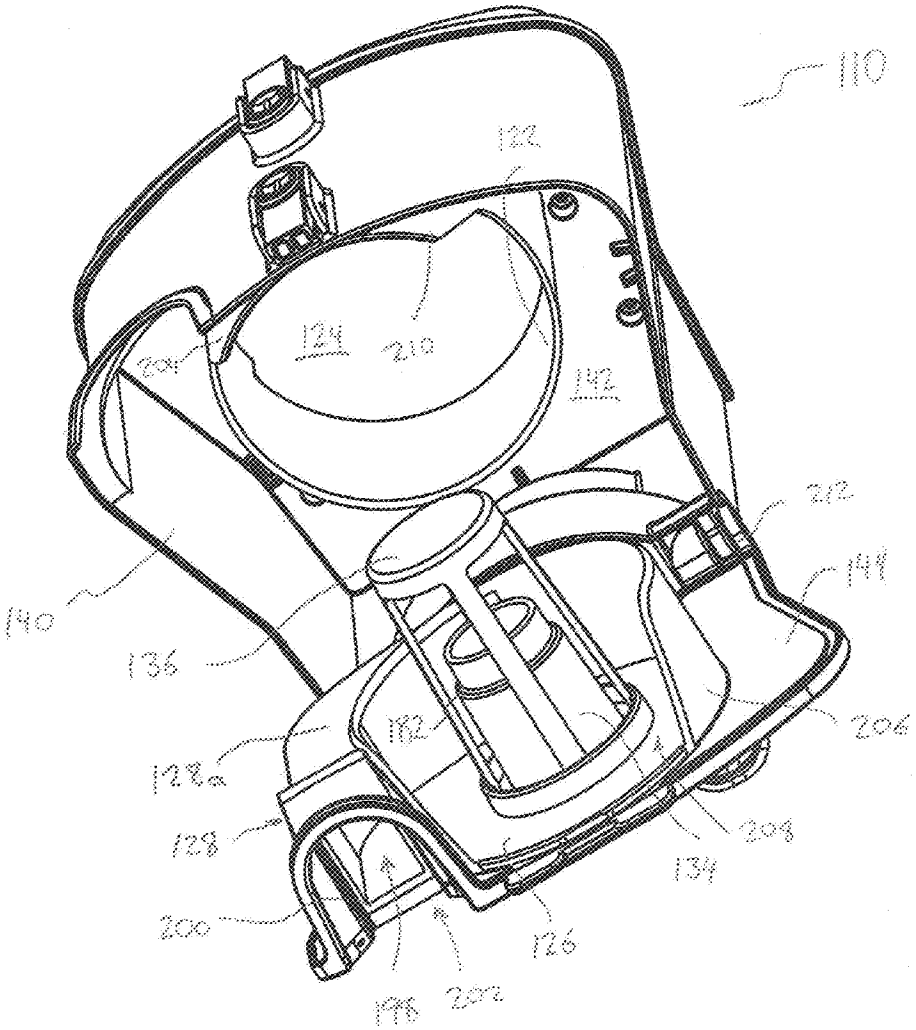
FIG. 12 is a lower perspective view of the cyclone bin assembly of FIG. 10, with the dirt collection chamber end wall in an open position; and, FIG. 13 is a section view of the surface cleaning apparatus of FIG. 2, taken along line 13-13.

Optionally, the vortex finder 134 can include an annular mounting shoulder 182 that is configured to rest on the upper face 184 of the vortex finder insert 180 (see also FIG. 12). With the cyclone bin assembly 110 seated on the platform 148, and the insert 180 received in the vortex finder 134, air exiting the cyclone chamber 118 can flow through both the vortex finder 134 and vortex finder insert 180 and into a filter chamber 186 in the body 112.

In the illustrated example, both the vortex finder 134 and vortex finder insert 180 have a circular cross sectional shape. Locating the vortex finder insert 180 within the vortex finder 134 can provide lateral alignment and front/back alignment of the cyclone bin assembly 110 on the platform 148, but may still allow relative rotation between the cyclone bin assembly 110 and the body 112.

Optionally, an engagement member can be provided to help retain the vortex finder insert 180 within the vortex finder 134. For example, a detent connection can be provided between the vortex finder insert 180 and the vortex finder 134 to help retain the vortex finder 134 on the insert 180.

Optionally, the cyclone bin assembly 110 can be configured so that vortex finder insert 180 serves as the vortex finder 134 in the cyclone chamber 118. In this configuration, vortex finder insert 180 may be removable received in the cyclone chamber 118. For example, the second cyclone endwall 126 may comprise an aperture that is sized to receive the vortex finder insert 180 and to create a generally air tight seal. With the cyclone bin assembly 110 seated on the platform 148, the vortex finder insert 180 is inserted into cyclone chamber 118 and may then serve as the vortex finder within the cyclone chamber 118. When the cyclone bin assembly 110 is removed, the vortex finder insert 180 is removed from cyclone chamber 118 and no vortex finder remains in cyclone chamber 118. Optionally, a relatively short annular lip can be provided around the perimeter of the aperture. The inner surface of the lip can rest against the outer surfaces of the vortex finder insert 180 and may help seal the cyclone chamber 118. The lip and/or vortex finder insert 180 can each be tapered, and optionally can be configured as a morse taper to help seal the cyclone chamber 118. Alternatively, the body 112 may not include a vortex finder insert 180, and the outlet of the vortex finder 134 can be sealed against an air inlet aperture in the platform 148.

Referring to FIGS. 7-10, optionally, the at least one alignment member 178 can also include at least one rotational alignment member 188. The rotational alignment member may be utilized to orient the cyclone bin assembly on main body 12. In the illustrated example, a tongue 190 extending from the rear of the cyclone bin assembly lid 154 can cooperate with a corresponding slot 192 in the body 112 to serve as a rotational alignment member 188. The slot 192 is sized and shaped to receive the tongue 190 in one desired alignment. When the tongue 190 is positioned within the slot 192 the cyclone bin assembly 110 is provided in the desired, operating and mounting orientation. The interaction between the tongue 190 and the slot 192 may also help provide lateral and front/back alignment of the cyclone bin assembly 110. Preferably, as exemplified, the first power connector 164 is provided on the underside of the tongue 190, and the second power connector 166 is provided within the slot 192.

Suction Hose Connector

Preferably, the suction hose connector 108 is mounted to the main body 112 so as to remain in position when the cyclone bin assembly 110 is removed. Alternately, or in addition, the hose connector 108 is nested or recessed into the cyclone bin assembly 110.

As exemplified, preferably the suction hose connector 108 is connected to the platform 148, and remains connected to the platform 148 when the cyclone bin assembly 110 is removed. The suction hose connector 108 comprises an air inlet 106 that may be connectable to a suction hose and is in communication with the opposing air outlet 130. A throat portion 196 of the suction hose connector 108 optionally extends between the air inlet 106 and air outlet 130. Coupling the suction hose connector 108 to the body 112 may help facilitate the removal of the cyclone bin assembly 110 (for example to empty the dirt collection chamber 120) while leaving the suction hose connected to the body 112, via the suction hose connector 108.

The air outlet 130 is configured to connect to the tangential air inlet 128 of the cyclone chamber 118. Referring to FIGS. 8 and 12, in the illustrated example, a sealing face 198 on the tangential air inlet 128 is shaped to match the shape and orientation of the air outlet 130 of the suction hose connector 108. Optionally, a gasket 200, or other type of sealing member, can be provided at the interface between the sealing face 198 and the air outlet 130.

The air outlet 130 of the suction hose connector 108 and the sealing face 198 of the tangential air inlet 128 may preferably be configured so that the sealing face 198 can slide relative to the air outlet 130 (vertically in the illustrated example) as the cyclone bin assembly 110 is being placed on, or lifted off of, the platform 148. As the cyclone bin assembly 110 is lowered onto the platform 148, the sealing face 198 may slide into a sealing position relative to the air outlet 130. In the sealing position, the gasket 200 is preferably aligned with the walls of the air outlet 130.

Optionally, part or all of hose connector 108 is recessed or nested within cyclone bin assembly 110. An advantage of this design is that the length of the surface cleaning apparatus may be reduced. A further advantage is that the hose connector 108 may be protected from impact during use.

Accordingly, the sealing face 198 may be recessed within the cyclone bin assembly 110. In the illustrated example, the cyclone bin assembly 110 includes a notch 202 in a lower surface that is configured to receive the throat portion 196 of the suction hose connector 108 when the cyclone bin assembly 110 is placed on the platform 148. With the cyclone bin assembly 110 on the platform 148, at least a portion of the throat 196 and the air outlet 130 are nested within cyclone bin assembly 110, which can help seal the air outlet 130 with the sealing face 198.

It will be appreciated that by nesting the hose connector in cyclone bin assembly 110, the suction hose connector 108 can serve as a rotational alignment member 188 to help guide the cyclone bin assembly 110 into a desired orientation.

Alternatively, in other embodiments the suction hose connector 108 may be fixedly connected to the cyclone bin assembly 110, and may be removable with the cyclone bin assembly 110.

Cyclone Chamber Wherein Part of the Sidewall Moves with a Openable End Wall

Optionally, as exemplified in FIG. 12, the cyclone chamber sidewall 122 comprises a split sidewall that includes a first portion 204 and a second portion 206. The first portion 204 remains in position when the when the second dirt collection chamber end wall 144 is opened. For example, first portion 204 may be attached to, and may be integral with, the first dirt collection chamber end wall 142. The second portion 206 is movable with the second dirt collection chamber end wall 144. When assembled, with the second dirt collection chamber end wall 144 in the closed position, the first and second portions 204, 206 provide a generally continuous and generally air impermeable cyclone sidewall 122.

The second portion 206 may include a notch 208 that is shaped to receive a corresponding tab 210 on the first portion 204. Preferably, the notch 208 in the second portion 206 is provided toward the free end (i.e. opposed to the pivoting end) of the second dirt collection chamber end wall 126, and away from the hinge 212. Providing the notch 208 in this location may help enable dirt and debris to be emptied from cyclone chamber 118 and may help reduce the likelihood of dirt and debris being retained by within the cyclone chamber 118 when the second dirt collection chamber endwall 144 is opened. For example, when second end wall 126 is pivoted open and faces downwardly, dirt on the surface of end wall 126 may fall through notch 208. It will be appreciated that notch preferably extends all the way to the surface of end wall 126 and may extend varying amounts around the sidewall 122.

Inlet 128 has an upper surface 128*a* (see FIG. 12). In the preferred embodiment, inlet 128 extends through the dirt collection chamber 120 and is mounted or moveable with end wall 126. Accordingly, the upper surface 128*a* comprises a dirt settling surface of the dirt collection chamber 120. When the dirt collection chamber is opened, inlet 128 moves with end wall 128. Accordingly, upper surface 128*a* is exposed and may face downwardly, thereby allowing dirt that has accumulated on upper surface 128*a* to be emptied.

Optionally, the vortex finder 134 and screen 136 are movable with the second cyclone endwall 126. In the illustrated example, the vortex finder 134 is integrally molded with the first cyclone endwall 124. In the illustrated example the dirt collection chamber sidewall 140 is a continuous, integral wall and does not split into upper and lower portions, or move with the second dirt collection chamber end wall 144.

Enhanced Dirt Collection Chamber Capacity

Preferably, the dirt collection chamber 120 surrounds a portion of the main body and, preferably a portion of the suction motor housing 216. Referring to FIGS. 7, 8, 10 and 13, the dirt collection chamber sidewall 140 comprises a recess 214 that is shaped to receive a corresponding portion of the body 112. In the illustrated example, the recess 214 is shaped to receive a portion of the motor housing 216 surrounding the suction motor 114. In this example, at least a portion of the dirt collection chamber 120 is positioned between the cyclone chamber 118 and the suction motor 114. Preferably, at least a portion of the dirt collection chamber 120 surrounds at least a portion of the suction motor 114 and the suction motor housing 216. In the illustrated example, the dirt collection chamber 120 surrounds only a portion of the motor housing 216. The shape of the recess 214 is preferably selected to correspond to the shape of the suction motor housing 216. Configuring the dirt collection chamber 120 to at least partially surround the suction motor housing 216 may help reduce the overall length of the surface cleaning apparatus 100, and/or may help increase the capacity of the dirt collection chamber 120.

The dirt collection chamber 120 may surround at least a portion of the cyclone chamber 118. Optionally, the dirt collection chamber 120 may be configured to completely surround the cyclone chamber 118.

Enhanced Filter Capacity

Preferably a filter (e.g., the pre-motor filter) overlies part or all of the cyclone bin assembly and the suction motor. This may increase the size of the pre-motor filter while maintaining a smaller footprint.

As exemplified in FIG. 13, air exiting the cyclone chamber 118 preferably flows to a suction motor 114 inlet via a filter chamber 186. The filter chamber 186 is provided downstream from the cyclone air outlet. Preferably, as exemplified, the filter chamber 186 extends over substantially the entire lower portion of the body 112 and overlies substantially all of the cyclone chamber 118, dirt collection chamber 120 and suction motor 114.

A pre-motor filter 218 is provided in the filter chamber 186 to filter the air before it enters the suction motor inlet 220. The pre-motor filter 218 is preferably sized to cover the entire transverse area of the filter chamber 186, and thereby overlies substantially all of the cyclone chamber 118, dirt collection chamber 120 and suction motor 114.

It will be appreciated that filter chamber 186 and pre-motor filter 218 may be smaller. Preferably, the cross sectional area (in the direction of air flow) of the pre-motor filter 218 is greater than the cross sectional area of the cyclone chamber 118 and/or the suction motor 114. In the illustrated example, the pre-motor filter 218 preferably comprises first and second pre-motor filters 218*a*, 218*b*. The filter chamber 186 comprises an air inlet chamber 222 on the upstream side 224 of the pre-motor filter 218, and an air outlet chamber 226 on the downstream side 228 of the pre-motor filter 218. Air can travel from the air inlet chamber 222 to the air outlet chamber 226 by flowing through the air-permeable pre-motor filter 218.

Preferably, the outer face (the side facing away from the cyclone air outlet) is the upstream side of the filter. Accordingly, the air inlet chamber 222 is spaced from and fluidly may be connected to the cyclone chamber air outlet by an inlet conduit 230 that extends through the pre-motor filter 218. In the illustrated example, the inlet conduit 230 is an extension of the vortex finder insert 180. The air outlet chamber 226 is in fluid communication with the inlet 220 of the suction motor 114.

The pre-motor filter 218 may be supported by a plurality of support ribs 232 extending through the air outlet chamber 226. Gaps or cutouts 234 can be provided in the ribs 232 to allow air to circulate within the air outlet chamber 226 and flow toward the suction motor inlet 220.

From the suction motor inlet 220, the air is drawn through the suction motor 114 and ejected via a suction motor outlet 116. Optionally, a post-motor filter 236 (for example a HEPA filter) can be provided downstream from the suction motor outlet 116, between the suction motor outlet 116 and the clean air outlet 104. A detachable grill 238 can be used to retain the post-motor filter 236 in position, and allow a user to access the post-motor filter 236 for inspection or replacement.

A bleed valve 240 may be provided to supply bleed air to the suction motor inlet 220 in case of a clog. The bleed valve 240 may be a pressure sensitive valve that is opened when there is a blockage in the air flow path upstream from the suction motor 114. Preferably, as exemplified, the bleed valve 240 may be co-axial with the suction motor 114 and may extend through the pre-motor filter 218. A bleed valve inlet 242 (see also FIG. 5) may be provided toward the rear of the body 112.

Optionally, a first end wall 244 of the filter chamber 186 can be openable to allow a user to access the pre-motor filter 218. In the illustrated example, the filter chamber end wall 244 is pivotally connected to the body 112 by a hinge 246 and can pivot to an open position. Releasable latch 150 may be used to secure the first end wall 244 in a closed position. The latch 150 can connect the filter chamber endwall to the cyclone bin assembly 110.

Hose Wrap

Preferably, a suction hose wrap is provided and the accessory tools are provided in a recess in the hose wrap and, preferably, in the bottom of the hose wrap. Alternately, or in addition, the suction hose wrap is located at one end of the vacuum cleaner (e.g., the bottom) and preferably is the stand of the vacuum cleaner (i.e., it is the part that sits on the floor).

Referring to FIGS. 1-9, the surface cleaning apparatus 100 may include a hose wrap portion 248, which may be of any design. The hose wrap portion 248 may be provided at either opposed end (e.g. top or bottom if oriented upright as illustrated) of the surface cleaning apparatus. Preferably, as exemplified, the hose wrap portion 248 extends from the bottom surface of the openable filtration chamber end wall 244 or, if an openable filter chamber is not provided, from the bottom of the platform.

Preferably, the hose wrap portion 148 functions as a stand for the surface cleaning apparatus. Accordingly, referring to FIG. 7, the hose wrap portion 248 may include a generally flat lower surface 250 and therefore function as a stand to support the surface cleaning apparatus 100 when it is not in use. Optionally, the lower surface 250 can function as a stand and can include a plurality of support feet 252 configured to rest upon a surface (for example a floor or a counter top). In the illustrated example, the surface 250 includes three integral support feet 252 formed from bosses extending from the lower surface 250.

Preferably, as exemplified in FIGS. 1-6, a suction hose recess 254 extends around the perimeter of the hose wrap portion 248. The suction hose recess 254 preferably has a radius of curvature 256 (FIG. 6) that is selected to generally match the radius of curvature of a suction hose 109 that can be used in combination with the surface cleaning apparatus 100. When the suction hose 109 is not in use, it can be wrapped around the hose wrap portion 248 for storage and may be at least partially received in the suction hose recess 254.

Figure 3:
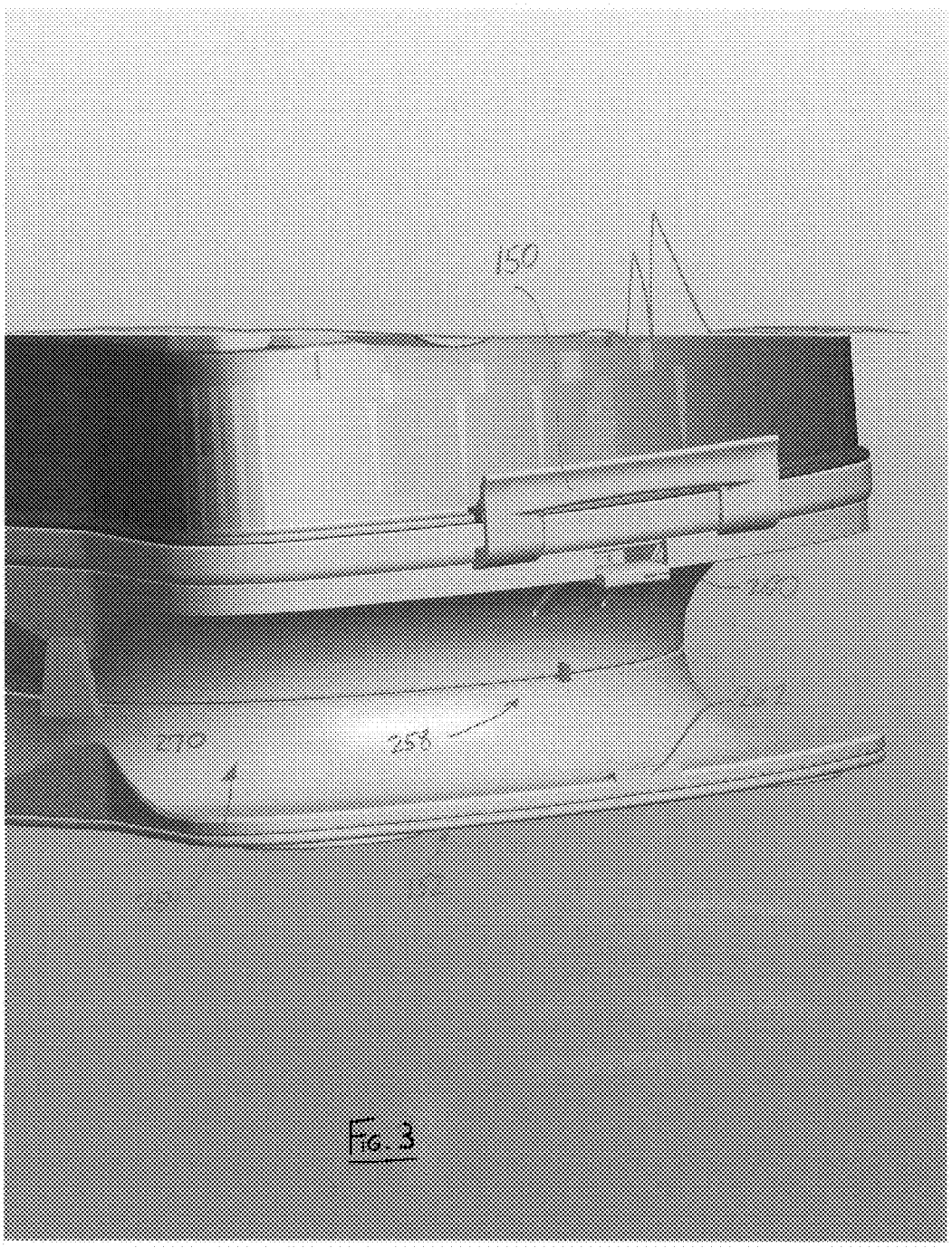
FIG. 3 is an enlarged view of a base portion of the surface cleaning apparatus of FIG. 2.

Referring to FIGS. 1-3, optionally, the suction hose recess 254 can include a hose securing detent 258, comprising upper and lower detent members 260, 262. The upper and lower detent 260, 262 members can frictionally engage a corresponding segment 264 of the suction hose 109. Engaging the suction hose 109 with the hose securing detent 258 may help retain the hose 109 in its storage position, within the hose recess 254. The suction hose segment 264 can include a hose detent groove 266 for receiving the upper and lower detent members 260, 262. Retaining the upper and lower detent members 260, 262 in the hose detent groove 266 can help prevent the suction hose 109 from sliding axially relative within the recess 254 while the suction hose 109 is wrapped in the recess 254. Optionally, the segment 264 of the suction hose retained by the upper and lower detent members 260, 262, and comprising the hose detent groove 266 can be separate hose retaining member 268 coupled to the suction hose 109. The hose retaining member 268 may be stiffer than the suction hose 109.

Alternatively, or in addition to the hose securing detent 258, the hose wrap portion 248 can include a hose securing member. In the illustrated example, the hose securing member comprises a mounting flange 270 that is shaped to engage a corresponding mounting notch 272 located on the suction hose 109. Sliding the mounting notch 272 over the flange 270 can help secure the upstream end of the suction hose in the storage position, in close proximity to the hose wrap portion 248. Optionally, the mounting notch 272 can be formed on a separate collar 274 that is coupled to the suction hose 109.

Referring to FIG. 13, in the illustrated example, the hose wrap portion 248 is arranged so that when the suction hose 109 is wrapped within the hose wrap recess 254, the plane 276 containing the suction hose is generally orthogonal to a cyclone axis 138 and a suction motor axis 278, as explained in greater detail below. Alternatively, the hose wrap portion 248 can be configured so that the plane 276 containing the suction hose is not orthogonal to one or both of the cyclone and suction motor axes 138, 278.

In the illustrated example, the hose wrap portion 248 is integrally formed from molded plastic. Optionally, the hose wrap portion 248 can be releasably connected to the body 112, and may be removable.

Figure 6:
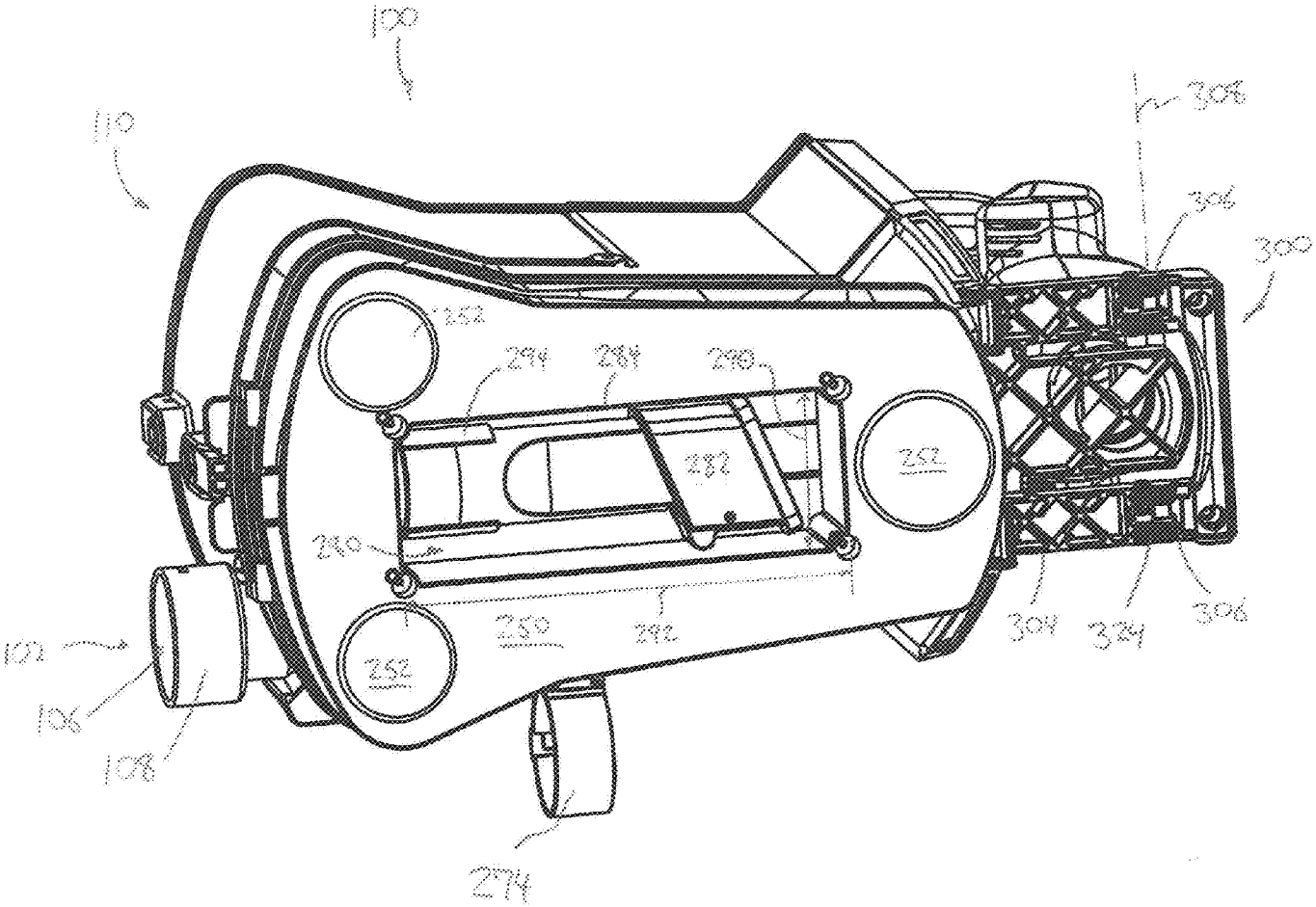
FIG. 6 is a bottom perspective view of the surface cleaning apparatus of FIG. 2.

Referring to FIGS. 6, 8 and 13, optionally, the hose wrap portion 248 can include a tool cavity 280. Preferably, as exemplified, the tool cavity 280 is provided in the lower surface of the hose wrap 248 and, more preferably generally centrally located within the perimeter of the hose wrap recess 254. One or more accessory cleaning tools 282 may be stored within the tool cavity 280 when the accessory tools 282 are not in use.

Preferably, as exemplified, the tool cavity 280 may include four side walls 284, an upper wall 286 and has an open bottom for allowing access to the tool stored 282 in the cavity 280. The tool cavity 280 has a cavity depth 288, a cavity width 290 and a cavity length 292. Alternatively, the tool cavity 280 may have an enclosed bottom and at least one open side 284 to allow access to the accessory tool 282, and/or the tool cavity 280 may include more than one open surface (for example the cavity may have an open bottom and at least one open side) or may have an openable door to provide access to the cavity. Preferably, the tool cavity 280 is configured so that the accessory tools 282 stored within the cavity 280 are accessible when the surface cleaning apparatus 100 is in use. More preferably, the tool cavity 280 is configured so that the accessory tools 282 in the cavity 280 are accessible while the suction hose is wrapped around the hose recess 254.

Optionally, the tool cavity 280 may include tool holders 294 for releasably securing one or more accessory tools 282 within the tool cavity 280. Preferably, as exemplified, the tool holder 294 comprises a tool mounting bracket extending from the upper wall 286 of the tool cavity 280. Preferably, as exemplified, the cavity depth 288 is selected to be greater than the thickness of the accessory tool 282 that is contained within the cavity 280, and the cavity width 290 and length are selected to be greater than the accessory tool width and length, respectively. Selecting a cavity 280 that is generally larger than the accessory tool 282 allows the accessory tool to be contained within the tool cavity 280, without extending beyond the lower surface 250 of the hose wrap portion 248. Recessing the accessory tool 282 within the cavity 280 may help enable the surface cleaning apparatus 100 to rest in a level orientation when the surface 250 is placed on a flat surface.

Cord Wrap

Preferably, a cord wrap is provided that permits the sliding removal of the cord without manually manipulating a cord retaining member (e.g., rotating a cord retaining member in a plane in which the cord is positioned when wrapped about the cord wrap).

Referring to FIGS. 4-6, the surface cleaning apparatus 100 may optionally include an electrical cord wrap 296 extending, preferably, from the rear of the body 112. The electrical cord wrap 296 comprises and at least two spaced apart cord retainers, e.g., upper cord retainer 298 and an opposing lower cord retainer 300 about which an electrical cord may be wound for storage. In the illustrated example, the upper cord retainer 298 is connected to the body 112 by an upper extension member 302, and the lower cord retainer 300 is connected to the body 112 by a lower extension member 304. Extension members are optionally provided if the location of the cord wrap is to be spaced from main body 12.

Preferably, at least one of the upper and lower cord retainers 298, 300 is moveable in a sliding cord removing direction, between a cord storage position, for retaining the electrical cord on the cord wrap, and a cord removal position, to help facilitate the removal of the electrical cord from the cord wrap. Optionally, the moveable cord retainer includes a biasing member that is configured to bias the cord retainer toward the cord storage position. Preferably, a locking member is not provided to lock the cord wrap member in a cord retaining position. Accordingly, a user may remove the cord by sliding the cord off of the cord wrap member. The cord wrap member will then automatically return to the cord retaining position. When desired, the cord may then be wrapped about the cord retaining members. Alternately, the cord wrap member may be manually positionable in both the cord retaining position and the cord removal position.

In the illustrated example, the lower cord retainer 300 is movably coupled to the lower extension member 304 by pivot joints 306. The lower cord retainer 300 is pivotable about rotational axis 308 (FIG. 6) and is moveable between a cord storage position (FIG. 5) and a cord removal position (FIG. 4).

Referring to FIG. 5, in the cord storage position, a retaining flange 310 extends generally transverse (e.g. downwardly), away from the lower extension member 304 and cooperates with a cord supporting surface 312 of the lower extension member 304 to form a retaining shoulder 314. The height 316 of the retaining shoulder 314 can be selected so that it is sufficient to retain the electrical cord on the lower cord retainer 300, and optionally, can be generally equal to or greater than the diameter of the electrical cord.

Referring to FIG. 4, in the cord removal position, the lower cord retainer 300 is pivoted or moved in the cord removal direction (e.g. rearwardly) so that a distal end 318 of the retaining flange 310 is raised above a plane 320 containing the cord supporting surface 312. Pivoting the retaining flange 310 above the plane 320 may help facilitate removal of the electrical cord coiled around the cord wrap 296. When the lower cord retainer 300 is in the cord removal position, the lower end of the coiled electrical cord can be slid off the lower extension member 304, in the direction indicated using arrow 322, without needing to pass over the retaining shoulder 314.

Preferably, the lower cord retainer 300 is biased toward the cord storage position. Referring to FIG. 6, in the illustrated example, each pivot joint 306 includes a spring member 324 biasing the lower cord retainer 300 toward the cord storage position. The stiffness of the springs 324 can be selected so that the lower cord retainer 300 can remain in the cord storage position and retain the electrical cord on the cord wrap 296 under normal handling, for example when the orientation of the surface cleaning apparatus 100 is changed while the electrical cord is wrapped. Optionally, the stiffness of the springs 324 can also be selected so that the force of a user pulling the coiled electrical cord off the cord wrap 269 is sufficient to overcome the spring force. Configuring the springs 324 to yield when a user attempts to remove the electrical cord from the cord wrap 296 may help facilitate an automatic rotation of the lower cord retainer 300, allowing the cord to be removed without requiring the user to first manually adjust the position of the lower cord retainer 300. When the electrical cord is clear of the lower cord retainer 300, the biasing force of the springs 324 may return the lower cord retainer 300 to the cord storage position. Automatically returning the lower cord retainer 300 to the cord storage position may help ensure that the cord wrap 296 is configured to retain the electrical cord when the user chooses to replace the electrical cord on the cord wrap 296.

Optionally, instead of, or in addition, to one or more springs 324, the biasing member for returning the lower cord retainer to the cord storage position may be another type of biasing device, including, for example an elastic member and a living hinge.

Referring to FIG. 5, in the illustrated example, the upper cord retainer 298 is a static cord retainer. The upper cord retainer 298 includes a static flange 326 (i.e., non-moveable) that cooperates with the cord supporting surface 328 of the upper extension member 302 to provide a cord retaining shoulder 330. In the illustrated example, the upper cord retainer 298 is integrally formed with the upper extension member 302. Optionally, in other embodiments the lower cord retainer 300 can be static and the upper cord retainer 300 can be the moveable cord retainer, or both the upper and lower cord retainers 298, 300 can be movable. In the illustrated example, the upper and lower cord retainers 298, 300 are located on opposite ends of the clear air outlet 104.

Optionally, an accessory tool holder 332 may be provided on the electrical cord wrap 296. Referring to FIGS. 5 and 6, the accessory tool holder comprises a tool mounting post 334 extending upward from the lower extension member 304. The tool mounting post 334 is sized to be received within the air outlet 338 of an accessory cleaning tool, including, for example a turbo brush 336 (FIG. 4). Preferably, the tool mounting post 334 has a slight friction or interference fit with the inner surface of the air outlet 338. Providing an interference fit between the tool mounting post 334 and the accessory tool may help to retain the accessory tool on the tool mounting post when the surface cleaning apparatus 100 is in use. Optionally, the interference fit between the tool mounting post 334 and the accessory tool may be the only retaining mechanism used to hold the turbo brush on the surface cleaning apparatus 100. Alternatively, or in addition to the interference fit, additional retaining mechanisms, including for example, clips, latches and magnets, can be used to help hold the turbo brush on the tool mounting post.

Preferably, the upper and lower cord retainers 298, 300 are spaced apart from each other by a distance that allows for at least a portion of the accessory tool to be disposed between the upper and lower cord retainers 298, 300. In this configuration, the accessory tool can be positioned relatively close to the rear of the body 112. Positioning the turbo brush 336 in close proximity to the body 112 may help reduce the overall length of the surface cleaning apparatus 100.

It will be appreciated that the following claims are not limited to any specific embodiment disclosed herein. Further, it will be appreciated that any one or more of the features disclosed herein may be used in any particular combination or sub-combination, including, without limitation, a moveable or removable power switch (preferably on or proximate the handle), a hose connector that is recessed into the cyclone bin assembly and preferably having the hose connector mounted to the main body and not a removable air treatment member, a suction hose wrap with a tool storage compartment, a suction hose wrap provided at one end, and preferably a lower end, of a surface cleaning apparatus whereby it may form a stand or base, a cord wrap with an automatic cord release which permits the sliding removal of the cord without having to manually move a cord retaining member, a cyclone chamber having a removable vortex finder or vortex finder insert, A dirt bin that partially surrounds the suction motor or suction motor housing, a filter that overlies at least part of a cyclone bin assembly and a suction motor and a cyclone chamber having a wall that splits when the cyclone chamber is opened.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

a) an air flow path extending from a dirty air inlet to a clean air outlet;

b) a main body comprising a suction motor provided in the air flow path and a platform;

c) a cyclone bin assembly provided in the air flow path and removably mounted on the platform, the cyclone bin assembly comprising a cyclone chamber; and, d) an alignment member provided on the platform and located at the air exit path of the cyclone bin.

2. The surface cleaning apparatus of claim 1 wherein the cyclone bin is rotatable about the alignment member.

3. The surface cleaning apparatus of claim 1 wherein the alignment member is tapered.

4. The surface cleaning apparatus of claim 1 wherein the alignment member comprises a portion of the air flow path.

5. The surface cleaning apparatus of claim 4 wherein the alignment member is centrally positioned on the platform.

6. The surface cleaning apparatus of claim 4 wherein the alignment member comprises a vortex finder of the cyclone chamber.

7. The surface cleaning apparatus of claim 4 wherein the cyclone chamber has a vortex finder and the alignment member comprises an insert receivable in the vortex finder.

8. The surface cleaning apparatus of claim 1 wherein the alignment member comprises a vortex finder of the cyclone chamber or an insert receivable in the vortex finder of the cyclone chamber and the alignment member is secured to the platform.

9. The surface cleaning apparatus of claim 8 wherein the cyclone is an inverted cyclone.

10. The surface cleaning apparatus of claim 1 further comprising a second alignment member.

11. The surface cleaning apparatus of claim 10 wherein, when mounted to the main body, the cyclone bin assembly is in a particular orientation and the second alignment member aligns the cyclone bin assembly in the particular orientation.

12. The surface cleaning apparatus of claim 10 wherein the cyclone bin assembly further comprises a handle and the handle comprises the second alignment member.

13. The surface cleaning apparatus of claim 12 wherein the main body has a recess configured to receive a portion of the handle.

14. The surface cleaning apparatus of claim 10 wherein the main body further comprises a hose connector, the hose connector comprising a portion of an air flow path from the dirt air inlet to the cyclone bin assembly and the hose connector comprises the second alignment member.

15. The surface cleaning apparatus of claim 14 wherein the hose connector is nested in the cyclone bin assembly when the cyclone bin assembly is mounted to the main body.

16. The surface cleaning apparatus of claim 14 wherein the hose connector is provided on the platform and the cyclone bin assembly has a recess for removably receiving the hose connector.

* * * * *